US006151473A

United States Patent [19]

Saito et al.

[11] Patent Number: 6,151,473

[45] Date of Patent: Nov. 21, 2000

[54] PEELED TONER SUPPLY ROLLER AND MANUFACTURING METHOD

[75] Inventors: Yoshiro Saito; Tetsuya Kobayashi, both of Numazu; Tetsuya Hase; Eiji Tanaka, both of Anjyo, all of Japan

[73] Assignees: Canon Kabushiki Kaisha, Tokyo; Inoac Corporation, Aichi-ken, Japan

[21] Appl. No.: 08/941,207

[22] Filed: Sep. 30, 1997

[30] Foreign Application Priority Data

Sep. 30, 1996 [JP] Japan ..... 8-278965

[51] Int. Cl.[7] ..... G03G 15/08

[52] U.S. Cl. ..... 399/281; 29/895.3

[58] Field of Search ..... 29/895.21, 895.3, 29/895.32; 492/16, 17, 18, 37; 399/265, 279, 281, 286; 428/314.2, 304.4; 264/162, 344, DIG. 68

[56] References Cited

U.S. PATENT DOCUMENTS

| | | | |
|---|---|---|---|
| 2,167,215 | 7/1939 | Leary . | |
| 3,139,826 | 7/1964 | Rainwater . | |
| 3,550,258 | 12/1970 | Odiorne . | |
| 3,750,250 | 8/1973 | Brown . | |
| 4,271,639 | 6/1981 | Talalay et al. . | |
| 4,299,022 | 11/1981 | Kummerl . | |
| 5,311,264 | 5/1994 | Kinoshita | 399/281 |
| 5,768,668 | 6/1998 | Shiraki et al. | 399/281 |

FOREIGN PATENT DOCUMENTS

| | | |
|---|---|---|
| 58-074329 | 5/1983 | Japan . |
| 58-092549 | 6/1983 | Japan . |
| 62-267110 | 11/1987 | Japan . |
| 5-061350 | 3/1993 | Japan . |
| 8-334970 | 12/1996 | Japan . |
| 8-334971 | 12/1996 | Japan . |

*Primary Examiner*—Robert Beatty
*Attorney, Agent, or Firm*—Fitzpatrick, Cella, Harper & Scinto

[57] ABSTRACT

A toner supply roller has a core material and sponge which forms a roller surface and whose surface is processed by cutting with a knife. The roller is used to form a toner image onto an electrostatic latent image bearing member.

6 Claims, 5 Drawing Sheets

PEELED TONER SUPPLY ROLLER AND MANUFACTURING METHOD

BACKGROUND OF THE INVENTION

1. Field of the Invention

The invention relates to a toner supply roller which is used for forming a toner image onto an electrostatic image bearing member, its manufacturing method, and a developing apparatus having such a roller. More particularly, the invention relates to a method of processing a toner supply roller suitable for forming a stable image.

2. Related Background Art

Hitherto, an image forming apparatus for developing by a non-magnetic one-component toner has been known.

In a developing apparatus using the non-magnetic one-component toner, a toner supply roller comes into contact with a developing roller and the toner supply roller is rotated, thereby supplying toner onto the developing roller.

Further, the toner supplied onto the developing roller is conveyed to a developing section which faces a photosensitive drum by the rotation of the developing roller. On the way of the conveyance, the toner is restricted by an elastic blade which is in contact with the developing roller, is coated onto a toner layer having a predetermined thickness, and is used for development in the developing section.

The toner supply roller is constructed in a manner such that an elastic sponge such as urethane foam, silicon foam, or the like is held on the surface of a core and an external surface of the held sponge is processed, thereby forming a cylindrical shape, namely, a roller-like shape. The roller-like processing, namely, an outer-diameter processing of the sponge is generally performed by a machine processing such as polishing by a bite or a melt cutting processing such as cutting by a nichrome wire which generated heat.

In case of using a sponge whose density is relatively high, when the outer-diameter processing by the melt cutting of the nichrome wire is performed, a melting degree of the surface of the sponge is large and a thin film is formed on the surface. Consequently, a conveying performance of the toner by the supply roller is deteriorated or a melted substance is entangled with the nichrome wire, thereby deteriorating a cutting ability of the nichrome wire or increasing a cutting resistance, so that an inconvenience such that a dimensional precision of the outer diameter remarkably deteriorates. Therefore, in the case of a material whose density is relatively high, the outer-diameter processing by polishing is generally performed.

A conventional processing method of the toner supply roller will now be described in detail hereinbelow. The toner supply roller made of urethane foam has been processed by the following five steps and has been put into practical use.

(1) Sectioning Process

First slab stock (sponge) is cut into a rectangular parallelepiped using a centrifugal peeling machine and horizontal table splitter.

(2) Boring

A hole to insert a core is bored into the urethane rectangular parallelepiped.

(3) Attaching the Core

A hot melt adhesive agent is coated onto the core, the coated core is inserted into the hole of the urethane rectangular parallelepiped, and the adhesive agent is heated and hardened at a temperature in a range from 180° C. to 200° C., thereby adhering the core to the urethane rectangular parallelepiped.

(4) Outer-diameter Processing

An external surface of the urethane rectangular parallelepiped made of the foaming material is polished by a bite or is melted and cut by a nichrome wire, thereby forming a cylinder. The polishing processing by the bite and the melt cutting processing by the nichrome wire will now be described in detail hereinbelow.

(4a) Polishing Processing

By pressing the bite of the polishing machine onto the urethane rectangular parallelepiped fixed in the horizontal direction and scanning the bite in the horizontal direction while rotating the rectangular parallelepiped around a horizontal axis, the external surface of the rectangular parallelepiped is polished, thereby obtaining a cylinder.

(4b) Melt Cutting Processing by a Nichrome Wire

A current is supplied to the nichrome wire fixed in the horizontal direction so as to generate heat, the nichrome wire which generates the heat is pressed onto the urethane rectangular parallelepiped, and the rectangular parallelepiped is rotated around the horizontal axis, thereby melting and cutting the external surface of the rectangular parallelepiped and obtaining a cylinder.

(5) Side Cutting

In order to set a length in the longitudinal direction of the cylinder to a predetermined length, both edge surfaces of the cylinder are cut to a desired length.

However, the toner supply roller obtained by the conventional processing method has the following problems.

(1) In Case of the Polishing Processing

After completion of the processing by polishing, a step of removing polishing powder by sucking or blowing the air or the like for the surface of the roller is needed. The polishing powder is likely to enter the sponge and it is difficult to completely eliminate the powder by the sucking or blowing of the air or the like. When the toner supply roller on which the polishing powder remains is used for development, the polishing powder is mixed into the toner. The toner containing the polishing powder is supplied to the developing sleeve and is sandwiched in a nip portion between the developing sleeve and the elastic blade, thereby obstructing a toner coating onto the developing sleeve. There is, consequently, a problem that a white stripe appears in the longitudinal direction on a developed image.

In case of processing by polishing, remaining portions of cells produced by cutting on the sponge surface remain in an inverted fuzzy state. The fuzz cannot be removed by air or the like. When the toner supply roller is used for development, the fuzz is torn off by the slide abrasion with the developing sleeve and becomes a cause of occurrence of the white stripe in the longitudinal direction on the image in a manner similar to the case of the polishing powder. Since there is a fear such that an outer diameter of the roller is largely fluctuated due to the influence by the fuzz, unless the outer diameter to be managed is set to a coarse value, a yield of the toner supply roller deteriorates. Further, since the polishing processing is executed while the bite is moving on the surface of the roller little by little, there is also a disadvantage such that it takes a long time for processing.

(2) In Case of Melt Cutting Processing by a Nichrome Wire

In case of a sponge in which a foaming density is high and a hardness is high and, further, in case of a sponge in which a diameter of foamed cell is small, since a load to be applied to the nichrome wire is large, the nichrome wire is easily deformed or torn off, so that a working precision deteriorates. On the other hand, when a processing speed is decreased so as not to apply a load onto the nichrome wire, the nichrome wire is not cut but a productivity of the toner supply roller deteriorates. When a current supply amount to the nichrome wire is increased and a heat generating temperature is raised, there is a problem such that a melting margin of the sponge is increased and a processing surface is deformed wavy and is not flattened.

SUMMARY OF THE INVENTION

It is an object of the invention to provide a toner supply roller which can prevent a defective supply of toner to a developing roller, its manufacturing method, and a developing apparatus.

Another object of the invention is to provide a toner supply roller which can prevent a defective image in a white stripe shape, its manufacturing method, and a developing apparatus.

Still another object of the invention is to provide a toner supply roller having a core material and a sponge in which a roller surface was peeling processed while said sponge is rotated around said core material as a center axis and a developing apparatus using such a roller.

Further another object of the invention is to provide a manufacturing method of a toner supply roller, comprising the steps of: preparing a sponge member having a core material; and peeling processing a surface of the sponge member, thereby forming the sponge member into a cylindrical shape.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will now be explained hereinbelow with reference to the drawings.

[Embodiment 1]

Figure 1:
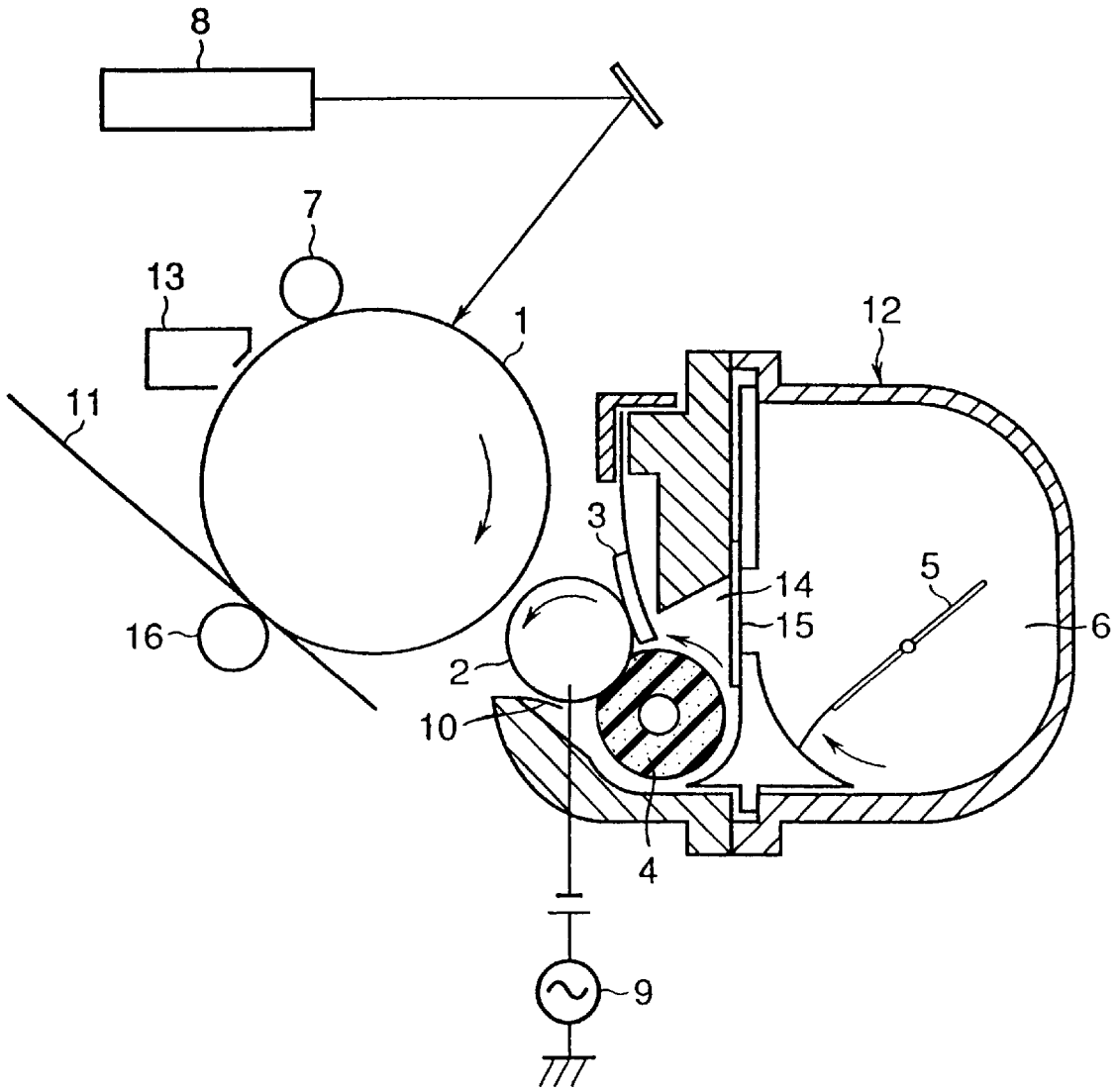
FIG. 1 is a constructional diagram showing an image forming apparatus having a developing apparatus according to an embodiment of the invention.

FIG. 1 is a constructional diagram showing an image forming apparatus having a developing apparatus according to an embodiment of the invention.

An image forming process in the image forming apparatus will now be explained. First, a surface of a photosensitive drum 1 as an electrostatic latent image bearing member is uniformly charged to VD=−700V by a primary charging unit 7. Subsequently, an image exposure is performed on the basis of image information by an exposing apparatus 8 which uses a laser beam as a light source and an exposed portion on the surface of the photosensitive drum 1 is set to VL=−500V, so that an electrostatic latent image is formed on the surface. The latent image is inversely developed by a developing apparatus 12 by using non-magnetic toner (non-magnetic one-component developing agent), so that it is visualized as a toner image. The toner image formed on the photosensitive drum 1 is transferred onto a transfer material 11 supplied to the photosensitive drum 1 by a transfer roller 16. The toner image transferred on the transfer sheet 11 is fixed by a fixing unit (not shown), thereby obtaining a permanent image. The residual toner which is not used to transfer and remains on the photosensitive drum 1 is cleaned by a cleaner 13.

The developing apparatus 12 is constructed as a non-magnetic one-component developing apparatus. The developing apparatus 12 has a toner chamber 6 and a developing chamber 14. A partition 15 which is removed when the developing apparatus 12 is first used is provided between the chambers 6 and 14. In the toner chamber 6, non-magnetic toner of a negative polarity is stored as a one-component developing agent and a conveying member 5 for conveying the toner to the developing chamber 14 is provided. In the developing chamber 14, a roll-shaped conductive developing sleeve 2 for bearing and conveying the toner is provided in an opening portion which faces the photosensitive drum 1 and a toner supply roller 4 is provided on a position near the toner chamber.

The toner supply roller 4 is formed in a manner such that an elastic sponge such as urethane foam, silicon foam, or the like is held on the surface of a core and an external surface of the held sponge is processed and formed in a cylindrical shape, namely, a roller-like shape. The toner supply roller 4 comes into contact with the developing sleeve 2 and is rotated so as to have a relative speed therewith, thereby supplying the toner conveyed by the conveying member 5 onto the developing sleeve 2. In the embodiment, an outer diameter of the toner supply roller 4 is set to 16 mm and a diameter of the core is set to 6 mm.

The toner supplied onto the developing sleeve 2 is conveyed to a developing section which faces the photosensitive drum 1 in association with the rotation of the developing sleeve 2, is restricted by an elastic blade 3 which is in contact with the developing sleeve 2 on the way of the conveyance, and is coated onto a toner layer having a predetermined thickness. The elastic blade 3 is a sole member having an elasticity such as an urethane rubber or the like or is formed by adhering a sheet such as an urethane rubber or the like onto an elastic metal member such as phosphor bronze or the like. The toner conveyed to the developing section is used for the development of the latent image on the photosensitive drum 1 by applying a developing bias by a power source 9 connected to the developing sleeve 2.

In this embodiment, a diameter of the developing sleeve 2 is set to 20 mm and, in order to accomplish an enough image density, a rotational speed of the developing sleeve 2 is set to 180 r.p.m. so as to rotate at a peripheral speed of about 190% of a peripheral speed of the photosensitive drum 1 corresponding to a processing speed of the image forming apparatus. The image forming apparatus is constructed so that 12 sheets of papers of the A4 size can be outputted per minute by setting the processing speed to 100 mm/sec.

It is a large feature of the invention that the sponge of the toner supply roller 4 in the developing apparatus 12 is processed to a roller shape by a peeling processing (the outer-diameter processing). The peeling processing according to the invention will now be described hereinbelow with reference to FIGS. 2 and 3.

Figure 2:
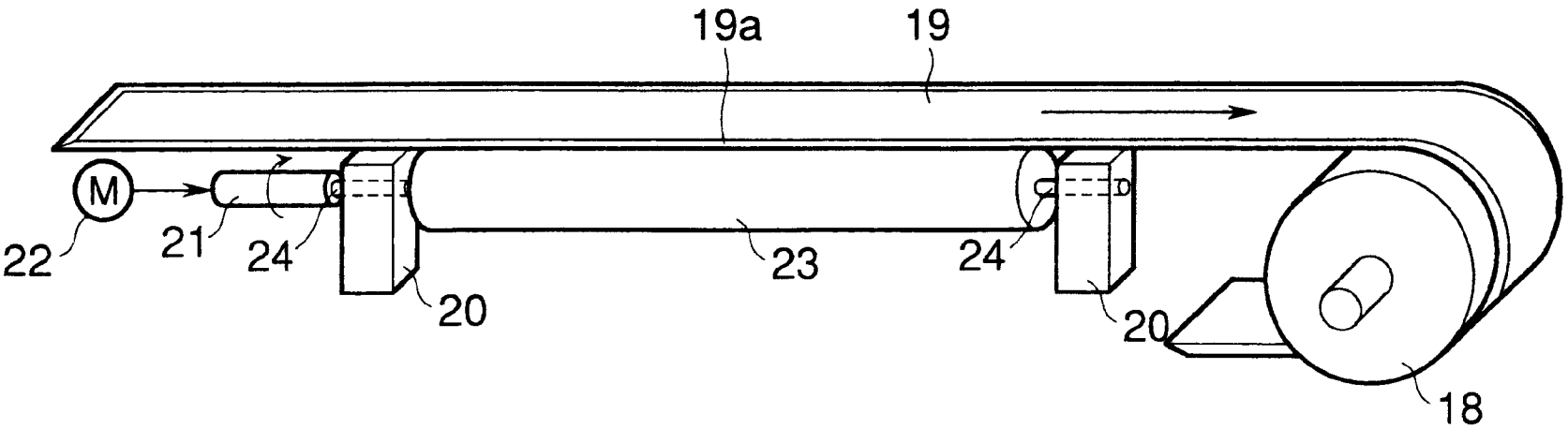
FIG. 2 is a perspective view schematically showing a peeling processing apparatus which is used for processing an outer diameter of sponge of a work of a toner supply roller of the developing apparatus installed in FIG. 1.

As shown in FIG. 2, a peeling processing apparatus which is used in the invention comprises: a band knife 19 in which at least one of the both edges in the width direction is formed as a knife edge 19*a;* a pair of supporting base plates 20 for supporting a work 23 to be formed as a toner supply roller 4; and a motor 22 for rotating the work 23.

The band knife 19 is attached between a pair of horizontal rollers 18 (only one of them is shown) and is endlessly rotated in the direction of an arrow in the diagram by a driving apparatus (not shown). The pair of supporting base plates 20 are arranged so as to have an interval in the horizontal direction which is the same direction as the running direction of the band knife 19 at a position near one end in the width direction of an orbit on the upper side of the band knife 19. The supporting base plates 20 are arranged so as to be movable in the forward and backward directions for the band knife 19 and horizontally and rotatably support the work 23 via cores (axes) 24 which are projected from both edges of the work 23, thereby enabling the work 23 to be pressed onto the knife edge 19*a* of the band knife 19. The supported work 23 is rotated by the motor 22 via a chuck 21 which grasps one of the edges of each core 24.

Figure 3:
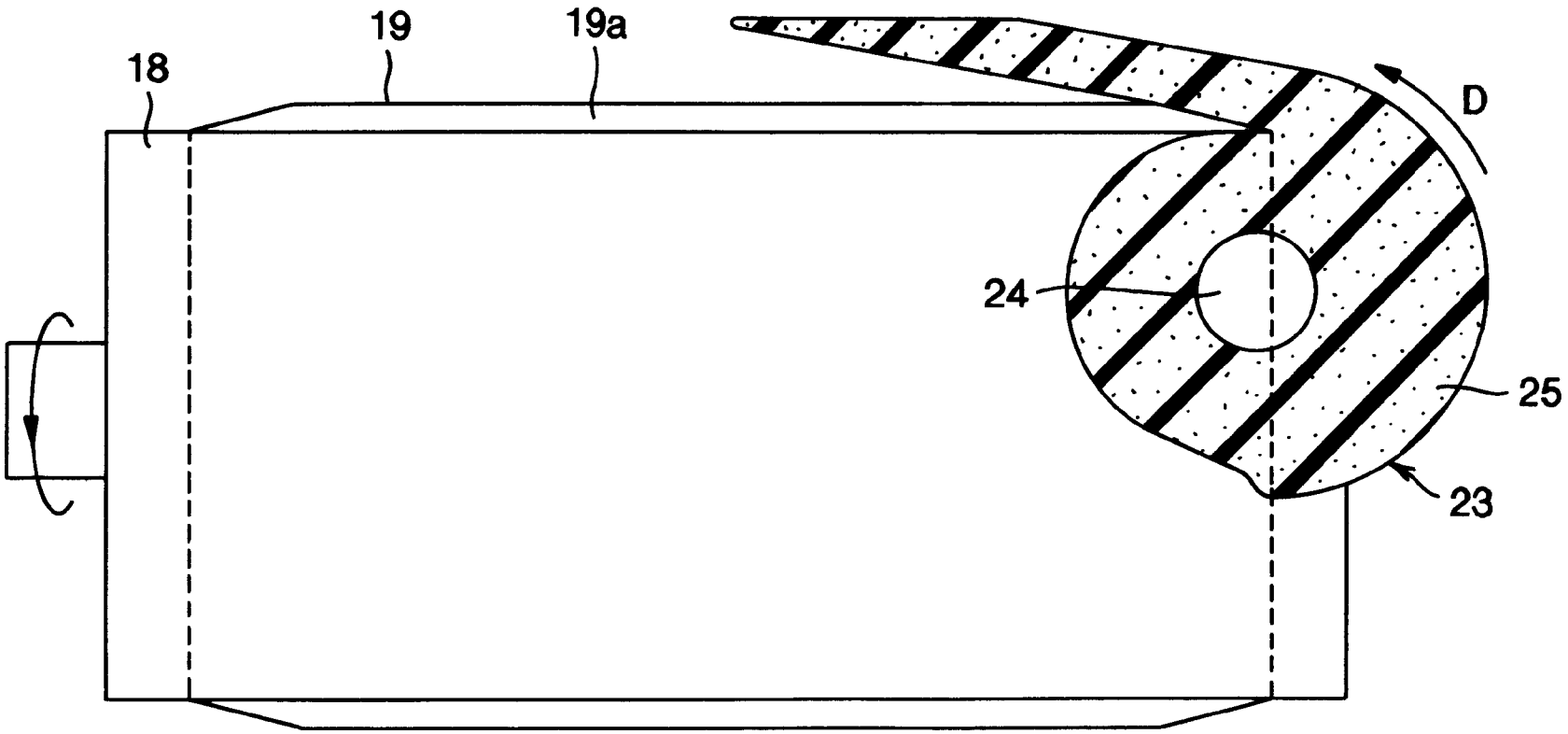
FIG. 3 is a cross sectional view showing a state in which the outer diameter of the sponge of the work is processed by a peeling processing of the processing apparatus of FIG. 2.

As shown in FIG. 3, the work 23 is manufactured in a manner such that a hole is formed in sponge 25 of a proper shape such as rectangular parallelepiped, cube, cylinder, or the like obtained by cutting piece goods of sponge by a centrifugal peeling machine or a cutting machine and the core 24 is inserted into the hole and is adhered and fixed by a hot melt resin or the like.

When the work 23 is supported by the supporting base plates 20, the work 23 is slowly rotated in the direction of an arrow D around the center axial line by the motor 22 and is also moved in the horizontal direction up to the band knife 19 which is rotating at a high speed and one end on the circumferential direction of the work 23 is pressed onto the knife edge 19*a* of the band knife 19 in the horizontal direction. The surface of the work 23 is cut so as to be peeled in the circumferential direction by rotating the work 23 by a length of one circumference or more while keeping it in the pressing state, so that the cylindrical work 23 is obtained. When the cutting of the work of one circumference or more is completed as mentioned above, the work 23 is moved away from the band knife 19 and the peeling processing is finished.

After that, in order to set the length in the longitudinal direction of the obtained cylinder 23 to a predetermined length, by cutting both edge surfaces of the cylinder 23 by a desired length, the toner supply roller 4 in which the sponge 25 held on the core 24 is processed in a roller shape is obtained.

In this embodiment, the toner supply roller 4 manufactured by performing the foregoing outer-diameter processing of the sponge by peeling is assembled to the developing apparatus 12 and is used for development. Tests of image formation were executed. The presence or absence of the appearance of the white stripe in the longitudinal direction on the 10th and 1000th images formed at that time was examined. For the purpose of comparison, a similar construction was used with respect to a case (Comparison 1) of using a toner supply roller in which an outer diameter of the sponge was processed by polishing by the bite and a case (Comparison 2) of using a toner supply roller in which an outer diameter of sponge was processed by melting and cutting by the nichrome wire. The results are shown in Table 1.

TABLE 1

| | Embodiment 1 | Comparison 1 | Comparison 2 |
|---|---|---|---|
| Sponge processing method | Peeling | Polish | Cutting by nichrome wire |
| White stripe on the 10th sheet | None | Occur | None |
| White stripe on the 1000th sheet | None | Occur | Occur |

In Table 1, according to Comparison 1, the fuzz which is caused at the time of polishing of the sponge of the toner supply roller 4 is sandwiched between the developing sleeve 2 and elastic blade 3 immediately after the start of the image formation and obstructs a coating of the toner on the developing sleeve 2 by the elastic blade 3, so that a white stripe appears on the image derived. After that, even if an output of the image is continued, the fuzz is not removed and the white stripe is not extinguished until the end of the image formation test.

According to Comparison 2, since the surface of the sponge is melted by the nichrome wire which generated the heat, there is no fuzz on the surface of the toner supply roller 4 and no white stripe appears even on the tenth image in the image formation. However, when the output of the image is continued, numerous white stripes are caused on the image. This is because according to the nichrome wire cutting, since a melting margin of the surface portion of the sponge is large, the melted sponge is condensed at some places and forms balls. The balls are removed due to the slide abrasion with the developing sleeve 2 for a long time and sandwiched between the developing sleeve 2 and elastic blade 3, thereby obstructing a coating of the toner.

On the other hand, in the embodiment 1, since an outer diameter of the sponge is processed by the peeling processing, there is no fuzz on the surface of the toner supply roller 4 and the surface has a uniform foamed structure itself of the sponge. Thus, images of a high quality without a white stripe were obtained for a period of time from the beginning of the image formation to the end of the test.

[Embodiment 2]

As mentioned above, according to the embodiment 1, the sponge of the toner supply roller 4 has been formed in a roller shape by the peeling processing. However, in the case where the sponge is particularly soft and the sponge is easily deformed when the band knife 19 is come into contact therewith, line-shaped projections (burrs) are likely to occur at the cutting start and end positions when the band knife is inserted and ejected into/from the sponge. A condition to prevent the burrs is very delicate and it is difficult to prevent them. When the burrs occur, an unevenness occurs in a toner supply amount of the toner supply roller 4 and appears as a stripe in the lateral direction on the image. Particularly, in case of using the soft sponge or the like, therefore, it is necessary to take new means which can certainly extinguish the burrs.

In this embodiment, therefore, after the peeling processing was performed, the burrs existing at the cutting start and end positions of the sponge are melted and extinguished by using a method similar to the singing.

The foregoing singeing is a method which has hitherto been used in order to eliminate the fuzz on the surface of the toner supply roller formed by a polishing processing Japanese Laid-Open Patent Application No. 08-334970. According to this method, the nichrome wire which generated heat by a current supply is made to approach in a contactless state without pressing onto the sponge as in case of the cutting of the nichrome wire and only the fuzz on the sponge surface is fused and eliminated, thereby smoothing the surface.

When the singeing is applied to Comparison 2 in which the outer diameter of the sponge is processed by the nichrome wire cutting mentioned in the embodiment 1, in Comparison 2, since the melting margin of the sponge due to the nichrome wire cutting is large, the melting margin is condensed to a ball by the singeing. According to the embodiment 2, however, since only the burr portions at the cutting start and end positions of the sponge by the band knife are melted, a ball-shaped condensation is not caused due to the singeing, the burrs are preferably removed, and the sponge surface can be made smooth.

The toner supply roller 4 of the embodiment is built in the developing apparatus 12 in a manner similar to the embodiment 1 and is subjected to the development and image forming experiments are executed. Thus, images of a high quality without a white stripe were obtained with respect to the 10th and 1000th images formed.

In this embodiment, the removal of the burrs of the sponge due to the singeing is performed after completion of the peeling processing as mentioned above. According to the invention, however, the burr removal and the peeling processing can be also simultaneously executed. In case of the conventional polishing processing, since the polishing is performed while scanning a bite in the longitudinal direction (horizontal direction) of the sponge, the polishing processing of the sponge and the elimination of the fuzz due to the singeing cannot simultaneously be performed. According to the peeling processing by the band knife 19, however, by using a method of arranging the nichrome wire at a lower position or the like near the knife edge 19*a* of the band knife 19 or the like, the burr removal by the singeing can be easily performed at the same time with the peeling processing of the sponge. Therefore, in an improved state of a productivity, the toner supply roller having the smooth surface can be obtained.

[Embodiment 3]

In an image forming apparatus using a recent electrophotographing system, a high resolution and a high gradation are more and more requested. However, there is an improvement of a developing agent as one of means for improving those performances. There is used a method of reducing a grain diameter of toner that is used and improving a fluidity of the toner so as to make it difficult to condense the toner.

Figure 4:
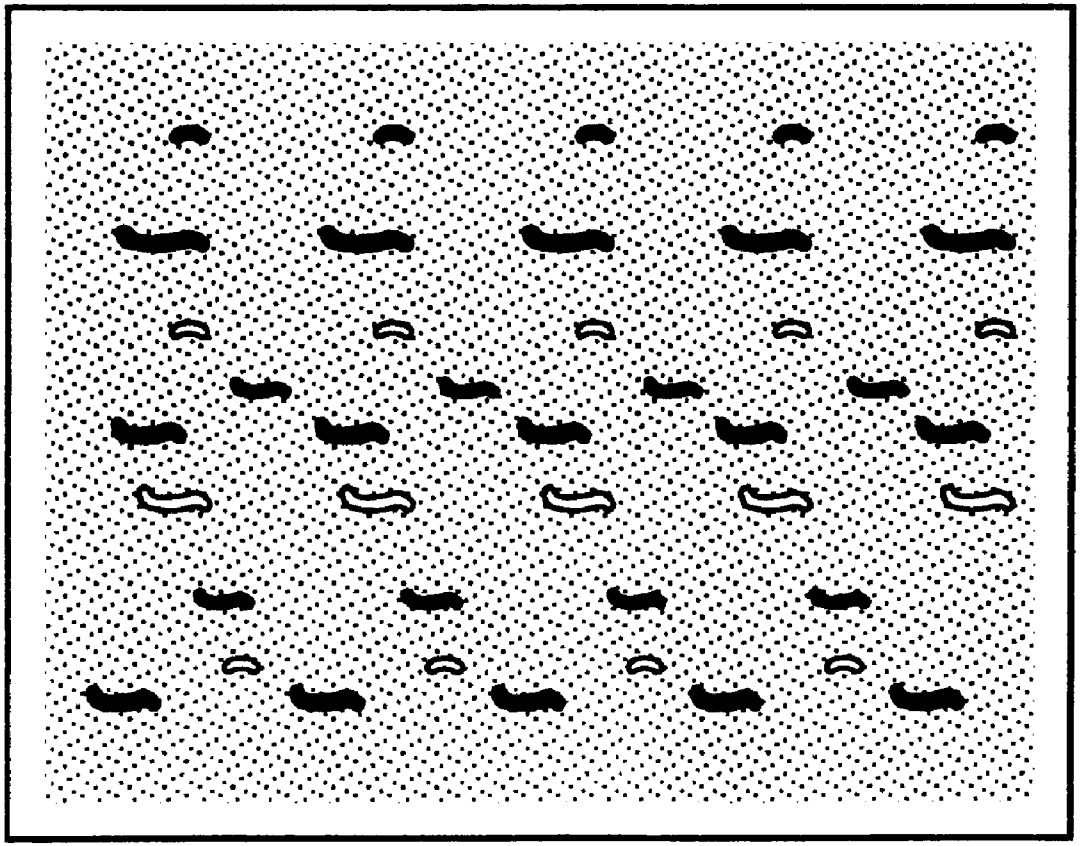
FIG. 4 is an explanatory diagram showing an unevenness of an image which is generated when a toner supply roller whose surface is not smooth is used.

A supplying performance of the toner to the developing sleeve 2 is easily influenced by a surface of the toner supply roller 4. Unless the surface is smooth, the toner is not uniformly supplied and a toner layer having an unevenness is coated onto the developing sleeve 2 due to a restriction by the elastic blade 3. When there is an unevenness in toner layer on the developing sleeve 2, as shown in FIG. 4, an unevenness appears in the image having a wide area such as a solid image and remarkably deteriorates a quality. There is a tendency such that this unevenness occurs synchronously with a rotational period of the toner supply roller 4.

In this embodiment, therefore, effects of the toner supply roller 4 for the solid image were examined. As mentioned above, the toner supply roller 4 used in the embodiment 3 is formed by processing the outer diameter of the sponge into the roller shape by the peeling processing. For comparison, similar rollers were used in the case of using a toner supply roller in which the outer diameter of the sponge is processed by polishing (Comparison 3) and the case of using a toner supply roller in which the outer diameter of the sponge is processed by a melt cutting by the nichrome wire (Comparison 4). The results are shown in the following Table 2.

TABLE 2

| | Embodiment 3 | Comparison 3 | Comparison 4 |
|---|---|---|---|
| Sponge processing method | Peeling | Polishing | Cutting by nichrome wire |
| Solid image of 1st sheet | Uniform | Uneven | Uniform |
| Solid image of 1000th sheet | Uniform | Uniform (white stripe) | Uneven (white stripe) |

In Table 2, in case of Comparison 3, the fuzz which is caused when the sponge of the toner supply roller 4 is polished exerts an influence on the supply of the toner onto the developing sleeve 2 and, in the formation of the first image, a solid image having an unevenness as shown in FIG. 4 is obtained. After that, when the output of the image is continued, the unevenness of the solid image is extinguished. It is considered that this is because by repeating the image output, the fuzz is removed from the surface of the toner supply roller 4 and the surface becomes smooth. However, in the 1000th solid image, although the unevenness which seems to be caused due to the toner supply roller doesn't exist, as described in the embodiment 1, the fuzz is sandwiched between the developing sleeve 2 and elastic blade 3, so that a white stripe appears on the image.

According to Comparison 4, since the sponge surface has been fused due to the melt cutting by the nichrome wire, there is no fuzz and an unevenness doesn't occur even on the first solid image. However, in the melt cutting, since the melting margin of the surface portion of the sponge is large, if the image formation is continued, the melted portions are condensed to balls. The balls are removed by the slide abrasion with the developing sleeve for a long time, concave and convex portions are formed on the sponge surface, and the toner layer on the developing sleeve becomes uneven.

On the other hand, since the toner supply roller 4 used in the embodiment is obtained by processing the outer diameter of the sponge by the peeling processing, there is no fuzz on the surface of the toner supply roller 4 and the surface has a uniform foamed structure of the sponge itself. Thus, images of a high quality without a white stripe were obtained for a long period of time from the beginning of the image formation to the end of the tests.

[Embodiment 4]

Figure 5:
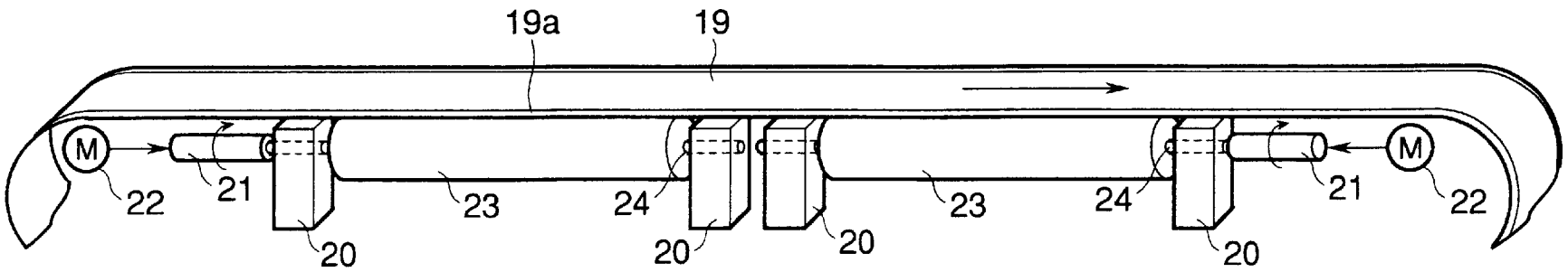
FIG. 5 is a perspective view schematically showing a peeling processing apparatus which is used in another embodiment of the invention.

An embodiment will now be described with respect to a case where when a size of toner supply roller 4 is small, the peeling processing of the sponges of a plurality of toner supply rollers are performed in a lump. FIG. 5 shows a schematic construction of a peeling processing apparatus which is used in the embodiment.

The processing apparatus in the embodiment is constructed in a manner such that two sets of pairs of supporting base plates 20 for supporting the work 23 of a small size are provided for the band knife 19, chucks 21 each for grasping one of the cores 24 of the works 23 supported by the supporting base plates 20 and the motors 22 each for rotating the work 23 through the chuck 21 are arranged. The two works 23 supported to the supporting base plates 20 are rotated by the motors 22. The two works 23 are pressed to the knife edge 19*a* at one end in the width direction of the upper orbit of the band knife 19 which rotates at a high speed. Thus, with respect to the two works 23 of a small size, the peeling processings of those sponges can be simultaneously performed.

The processing apparatus of the embodiment 1 shown in FIG. 2 can perform the peeling processing to one work of, for example, the A3 size (sponge length is equal to about 310 mm). However, in case of a work of the A4 size (sponge length is equal to about 220 mm) that is smaller than the A3 size, the peeling processing cannot be performed to two works together. The processing apparatus of the embodiment can simultaneously perform the peeling process to two works of the A4 size. Therefore, when considering the processing per work, this equivalently results in a decrease in processing time, a productivity is improved, and costs can be reduced.

In the above embodiment 4, two motors 22 are provided and each work 23 is rotated by each motor 22. However, it is also possible to provide one motor for two works 23 and to rotate the works together. Although the example of simultaneously processing two works of the A4 size has been shown, in case of works of a small size, by providing three or more sets of pairs of supporting base plates 20 and the like, the invention can also similarly cope with such a case.

[Embodiment 5]

In each of the foregoing embodiments 1 to 4, after completion of the outer-diameter processing of the sponge of the toner supply roller 4, the cutting processing (side cutting processing) of both edge surfaces of the sponge is executed, thereby accurately setting the length in the longitudinal direction of the sponge to a predetermined dimension (setting of the precise dimension in the longitudinal direction). According to the embodiment 5, however, the dimension in the longitudinal direction is set by performing the side cutting processing of the sponge before the outer-diameter processing.

The work 23 in peeling process which is shown in FIG. 3 comprises a predetermined-shape sponge 25 cut into rectangular parallelepiped, cubic or cylinder or the like and a core 24 which set with the sponge 25. Therefore the sponge 25 has been already cut out from slab stock with process of end-trimming process and it has been in a work-in-peeling-process state of a dimension with predetermined length. According to this method, by merely performing the peeling processing to the work 23 by the band knife 19, a product of the toner supply roller can be obtained.

When the outer-diameter processing of the sponge is performed by polishing, the sponge is likely to be torn off in both edge portions in the longitudinal direction and the sponge enters a state in which the surface textures in both edge portions of the toner supply roller are unevenly made rough. Therefore, when the outer-diameter processing by polishing is performed after the dimension in the longitudinal direction was set, a toner supply roller in which the surface textures in both edge portions are uneven is provided. If such a supply roller is used for development, uneven coating states are caused at the positions corresponding to the toner supplied to the developing sleeve and the both edge portions of the supply roller, so that inconveniences such as density unevenness, fogging, and the like are caused in the image edge portions due to factors of them. Therefore, in case of using the outer-diameter processing by polishing, it is a general way to perform the polishing to slightly long sponge and, thereafter, to cut out the surplus sponges in both edge portions which were torn off by the side cutting, thereby setting the precise dimension in the longitudinal direction.

On the other hand, in the outer-diameter processing by the peeling which is executed in the invention, since the external surface of the sponge is cut by the band knife 19 which rotates at a high speed, stresses in both edge portions of the sponge are very small and the textures of both edge portions are not made rough. Therefore, a normal state when the setting of the precise dimension is performed can be maintained. This embodiment, consequently, has advantages such that the side cutting processing can be omitted and the costs of material can be reduced because no surplus sponge occurs.

According to the invention as described above, since the outer diameter processing of the elastic member is performed by the peeling processing for cutting the sponge-like elastic member by using the band knife which rotates at a high speed, no fuzz is formed on the surface of the toner supply roller obtained. A situation such that the torn-off fuzz is sandwiched between the developing sleeve and the elastic blade and obstructs the coating of the non-magnetic toner of the one-component developing agent onto the developing sleeve doesn't occur. Thus, a white stripe in the longitudinal direction doesn't appear on the developed image. Since the surface of the toner supply roller is very smooth, the toner is uniformly supplied to the developing sleeve and an image of a uniform density can be obtained.

In the outer-diameter processing by peeling, since the processing time is short and an efficiency is high, the costs of the toner supply roller can be reduced. Further, according to the peeling processing, in addition to that it is possible to easily cope with the outer-diameter processing of the toner supply roller in which the dimension in the longitudinal direction is large, there is also an advantage such that a plurality of outer-diameter processings can be simultaneously performed in the toner supply roller in which the dimension in the longitudinal direction is small.

Particularly, in the case of processing a sponge-like elastic member in which a hardness is low and which can be easily deformed, a condition to prevent the occurrence of burrs (projections) due to the peeling processing is delicate and is hard to be set. However, the burrs can be easily fused and removed by the singeing process by the nichrome wire or the like which generated the heat. Therefore, it is also possible to omit the step of setting the delicate condition to prevent the occurrence of burrs and to stably perform the outer-diameter processing by the peeling. Further, in the peeling processing, since the singeing can be also simultaneously performed, the processing efficiency can be also further improved.

Although the preferred embodiments of the invention have been described above, the present invention is not limited to the foregoing embodiments but many modifications and unevennesses are possible within the spirit and scope of the appended claims of the invention.

What is claimed is:

1. A method of manufacturing a toner supply roller, comprising steps of:

preparing a foamed material having a core material; and surface-processing a surface of said foamed material by a knife to form said foamed material into a cylindrical shape while said foamed material is rotated around said core material as a center axis.

2. A method according to claim 1, wherein said surface-processing is performed by rotating said foamed material by one rotation or more relative to said knife which moves in the longitudinal direction of said foamed material.

3. A method according to claim 1, wherein said surface processing is executed by a processing apparatus having said knife, a supporting member for supporting both edges of the core material of said foamed material, and a driving motor for rotating said foamed material.

4. A method according to claim 3, wherein said processing apparatus comprises a plurality of sets of paired supporting members and can perform the surface-processing of a plurality of foamed materials simultaneously.

5. A method according to claim 1, wherein said knife moves in a longitudinal direction of said foamed material.

6. A method according to claim 1, wherein said knife moves in a direction intersecting a rotating direction of said foamed material.

* * * * *